United States Patent [19]

Garrett

[11] 4,087,130

[45] May 2, 1978

[54] PROCESS FOR THE GASIFICATION OF COAL IN SITU

[75] Inventor: Donald E. Garrett, Claremont, Calif.

[73] Assignee: Occidental Petroleum Corporation, Los Angeles, Calif.

[21] Appl. No.: 787,710

[22] Filed: Apr. 14, 1977

Related U.S. Application Data

[63] Continuation of Ser. No. 628,063, Nov. 3, 1975, abandoned, which is a continuation of Ser. No. 456,203, Mar. 29, 1974, abandoned.

[51] Int. Cl.[2] ..... C10J 5/00

[52] U.S. Cl. ..... 299/2; 48/202; 48/204; 48/DIG. 6; 166/261; 166/263; 166/266

[58] Field of Search ..... 48/210, DIG. 6, 197 R, 48/202, 204, 206, 207; 166/261, 272, 256, 257, 263, 266; 299/2, 4

[56] References Cited

U.S. PATENT DOCUMENTS

| | | | |
|---|---|---|---|
| 1,913,395 | 6/1933 | Karrick | 48/DIG. 6 |
| 2,786,660 | 3/1957 | Alleman | 166/256 |
| 3,017,168 | 1/1962 | Carr | 299/4 |
| 3,298,434 | 1/1967 | Graham | 166/251 |
| 3,358,756 | 12/1967 | Vogel | 166/272 |
| 3,809,159 | 5/1974 | Young et al. | 166/272 |
| 3,865,186 | 2/1975 | Hippel | 299/2 |

OTHER PUBLICATIONS

"Underground Gasification of Coals," Chekin et al., Transactions of Chem. Engr. Cong. of World Power Conf., 3-1936.

"Subterranean Gasification of Coal" Nusinov, Canadian Chemistry and Process Industries, Jun. 1946.

*Primary Examiner*—Richard V. Fisher
*Assistant Examiner*—Peter F. Kratz
*Attorney, Agent, or Firm*—Max Geldin; William N. Patrick; William G. Lane

[57] ABSTRACT

Process for the gasification of coal in situ comprising driving shafts or tunnels into a coal seam, injecting air into the bore holes to ignite and burn the coal to raise its temperature ceasing the flow of air when the coal is hot enough to support the endothermic water gas reaction, and injecting steam into the hot coal formation, such steam preferably being preheated by the flue gases taken from the same end of the bore holes where the air was injected, and recovering product gases, including carbon monoxide and hydrogen, and also product oil, exiting the tunnel at the other end of the bore holes. When the temperature of the coal drops during injection of steam to a level which will just permit combustion, the steam flow is stopped, and the cycle is repeated by air injection and flue gas removal at the front end of the bore holes, and through the tunnel connected therewith. This cyclic process is repeated until the entire mass of coal within the area encompassed by the bore holes is exhausted.

35 Claims, 5 Drawing Figures

12
38
18
10
40
13
48
28
46
47
14
52
50
16
34
45
22
24
20
26

10
38
40
18
48
28
46
14
12
52
50
16
47
45
33
32
26
20
22
24
30

Fig. 2a
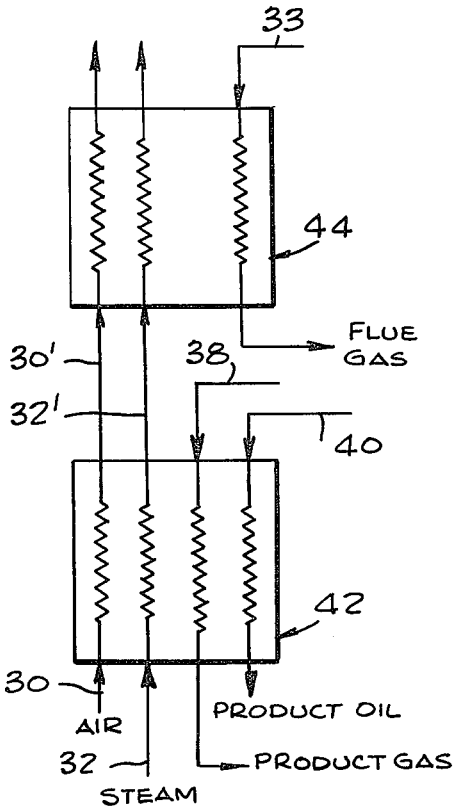
Fig. 3
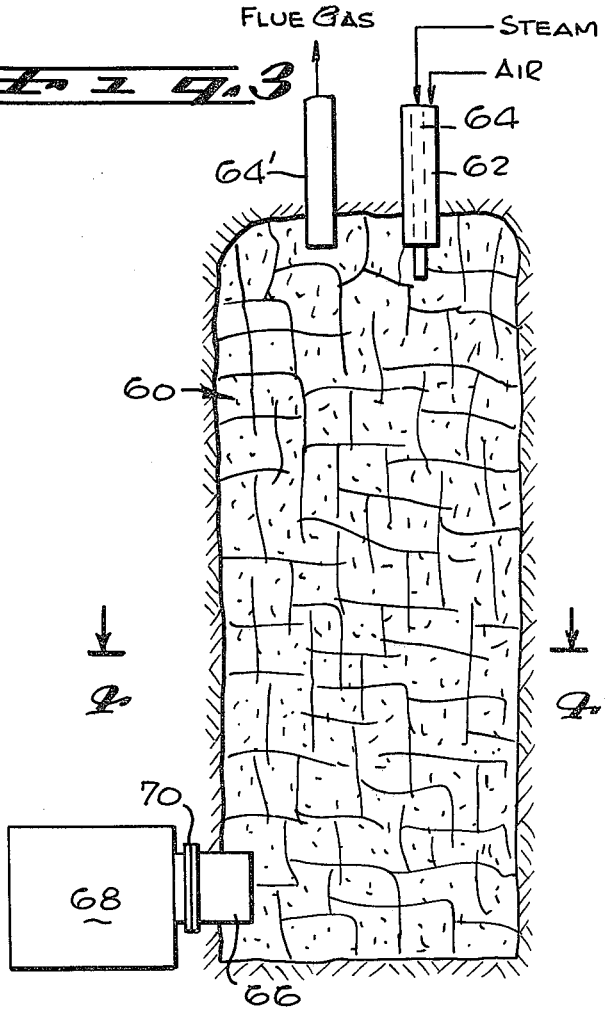
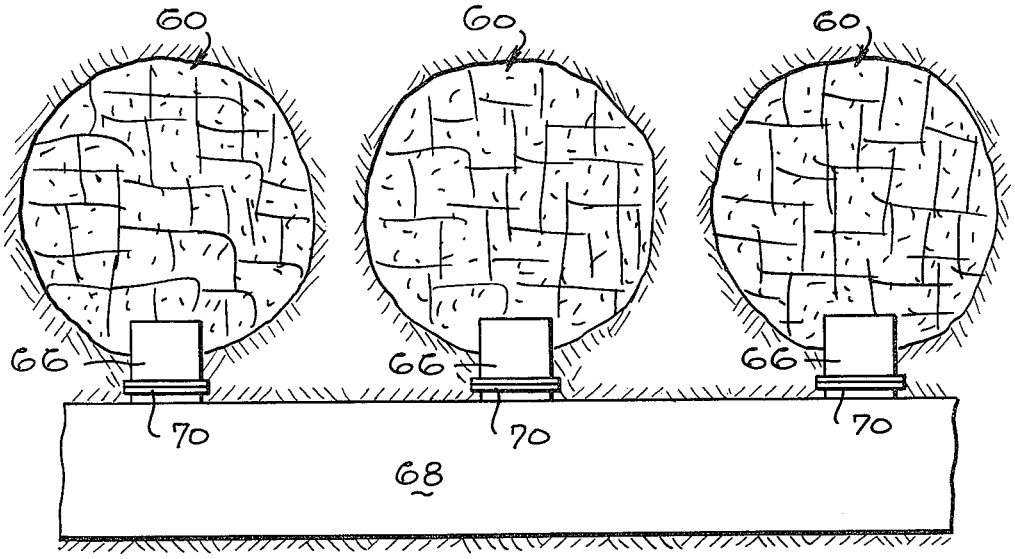
Fig. 2

PROCESS FOR THE GASIFICATION OF COAL IN SITU

This is a continuation of application Ser. No. 628,063, filed Nov. 3, 1975 which is a continuation of Ser. No. 456,203, filed Mar. 29, 1974, both abandoned.

BACKGROUND OF THE INVENTION

This invention relates to a process for the gasification of coal in situ, and is particularly concerned with a novel process for in situ gasification of coal which utilizes certain mining operations or techniques in combination with in situ gasification, to obtain superior results in the production of a product gas having higher or improved BTU content as compared to prior art processes.

The gasification of coal in place relates to the recovery of the energy of the coal without mining. The products are obtained in a gaseous form and may be utilized for producing electric power, the manufacture of organic chemicals and the synthesis of liquid or gaseous fuels. An advantage of the gasification of coal in place is the elimination of complex and expensive underground mining operations and the utilization of coal from beds which are not profitable to mine.

Considerable effort has been expended on studying the in situ gasification of coal, since many coal seams are so thin or of such low grade, or potentially could be exploited most economically by in situ gasification. In "Chemistry of Coal Utilization," pages 1023 and 1040, edited by H. H. Lowry, Wiley and Sons, New York 1963, there is set forth a review of the various processes which have been proposed for the underground gasification of coal. Thus, for example, there is disclosed processes in which a bore hole is driven down into the coal strata, the coal ignited, and air and water passed down, producing a gas containing hydrogen and carbon monoxide. U.S. Pat. No. 3,298,434 discloses a process for in situ gasification of coal wherein a well is first sunk to the coal seam and air and steam are injected and the product gas is recovered from the same injection well. In another form of the process of the above patent, both injection and production wells are drilled into the coal seam and a channel of communication is provided between the injection and the production wells to permit the flow of gases between the wells and the recovery of product gas from the production well.

However, in many of the proposed processes as exemplified by those of the above-noted prior art, the total coal recovery and the BTU content of the gas have been relatively poor because of inadvertent mixing with nitrogen or other inerts and by-passing of coal in the formation. Hence, in large measure, the processes heretofore proposed have been relatively inefficient in producing high yields of a sufficiently high BTU product gas.

Accordingly, one object of the invention is the provision of an improved method of burning and gasifying coal in situ under controlled conditions, to obtain the product gases and product oils.

Another object is to provide a method of gasification of coal which employs a combination of mining and in situ gasification techniques, to obtain a product gas of relatively high BTU content.

A still further object is the provision of an improved method of in situ gasification of coal under controlled conditions by injection of air and steam, in conjunction with certain mining techniques, so as to separate flue gases from the product gas and obtain high yields and a high quality product gas.

DESCRIPTION OF THE INVENTION

In accordance with the present invention it has been discovered that if certain mining preparations are first made in a given coal seam, e.g. by the provision of a system of tunnels and interconnecting bore holes, as described in greater detail hereinafter, and the in situ coal gasification process is then carried out by injection of air and steam in a controlled manner into the resulting system, substantially superior results can be obtained than heretofore achieved by prior art processes. These results are in large measure achieved by being able to place the air or oxyten at the desired site, as by location of thermocouples or other devices for temperature monitoring, and by segregating the flue gases from the product gas, resulting in high yields of a high quality gas, having relatively high BTU content. These results are further achieved, according to the invention, by the provision of a cyclic procedure, with the burning step occuring during the introduction of air or oxygen, and the water gas reaction step occuring during the introduction of steam, being repeated a number of times dependent upon the temperature of the coal.

According to a preferred embodiment, two or more shafts or tunnels are driven into the coal formation or seam and a series of bore holes are drilled between parallel tunnels. The coal in the bore holes adjacent one of the tunnels is ignited by suitable means such as remotely controlled electrical ignition or other means, and air is injected into the bore holes to burn the coal and raise its temperature. When it is hot enough to support the endothermic water gas reaction, the flow of air is discontinued and steam, which preferably has been preheated by the flue gases taken from the same end of the bore holes where the air was injected, is admitted to the hot formation, and product gases including carbon monoxide and hydrogen are permitted to exit into the tunnel at the opposite end of the bore holes. When the temperature of the coal has dropped to a level that will just permit combustion, the steam flow is stopped, as by a switching of valves, and the cycle is repeated by air injection and flue gas removal at the front end of the bore holes, followed by steam injection and removal of product gases at the far end of the bore holes. Such cyclic process is repeated until the entire mass of coal within the area encompassed by the bore holes is substantially completely exhausted, at which time a system of tunnels and bore holes is similarly provided in an adjacent area of the formation.

According to a simpler embodiment of the invention, particularly suited for practice where low price oxygen is available, the partial combustion by means of such oxygen, and the water gas reactions can be conducted simultaneously, by introduction of both the air and/or oxygen, together with the steam into the bore holes, in the manner described above, so that the entire process is reduced to a single operation, rather than two operations as noted above.

It is important for good thermal efficiency that there be good heat exchange between the inlet and outlet gases. Particularly where air is used rather than oxygen, and a two-step process is employed, wherein the hot flue gases leave the entry end of the bore holes and the product gas leaves at the exit end, heat exchange equipment preferably is employed at both ends for preheating of the air and steam. An economic balance can be made to determine the optimum amount of heat exchange for this purpose, but for most efficient operation, both the product gas and oil, and the exit flue gas, should be at reasonably low temperatures. Under these conditions, the incoming oxygen or air will be preheated to close to the combustion temperature, and of particular importance, the steam will be efficiently preheated.

It is desirable in carrying out the invention process, to continuously push the air and steam pipe into the bore holes as the combustion-gasification reactions are proceeding, in order to place the air and the steam near the burning front to minimize mixing of the flue gas with the product gas. The bore holes in all cases should be large enough so that as coking proceeds from the hot gases exiting through the formation, or as condensation occurs, the holes are not plugged. If desired, tailings may be pumped into the burnt out area to help support the roof as the combustion proceeds.

The invention process, in addition to producing a product gas, e.g. containing carbon monoxide and hydrogen, will also produce a fair amount of oil from the coking of the coal as the hot exit gases pass down the bore holes. The exit gases can be scrubbed clean of sulfur dioxide and other impurities and then either burned as a low BTU fuel or if desired, such gases can be further processed by means of carbon dioxide removal, shift conversion, and methanation for the production of a high BTU synthetic pipeline gas.

As a further modification of the invention process, for thick coal seams, the coal can be undercut or a sufficient amount of coal removed so that the entire mass may be blasted to provide permeability. The combustion front can be at the top of the fracture and porous coal body, if desired, and the gas products and oil can exit through the bottom of the mass. In a similar manner a coal seam that has previously been mined could have the pillars of the mine structure blasted into the open air to allow porosity for the exit gases.

The invention process will be more clearly understood by reference to the description below of certain preferred embodiments, taken in connection with the accompanying drawing wherein.

FIG. 2*a* illustrates heat exchange of the flue gas and hot exiting products with the inlet air and steam;

FIG. 3 is an elevational view illustrating an alternative mode of practicing the invention process; and FIG. 4 is a horizontal sectional view taken on line 4—4 of FIG. 3.

Figure 2:
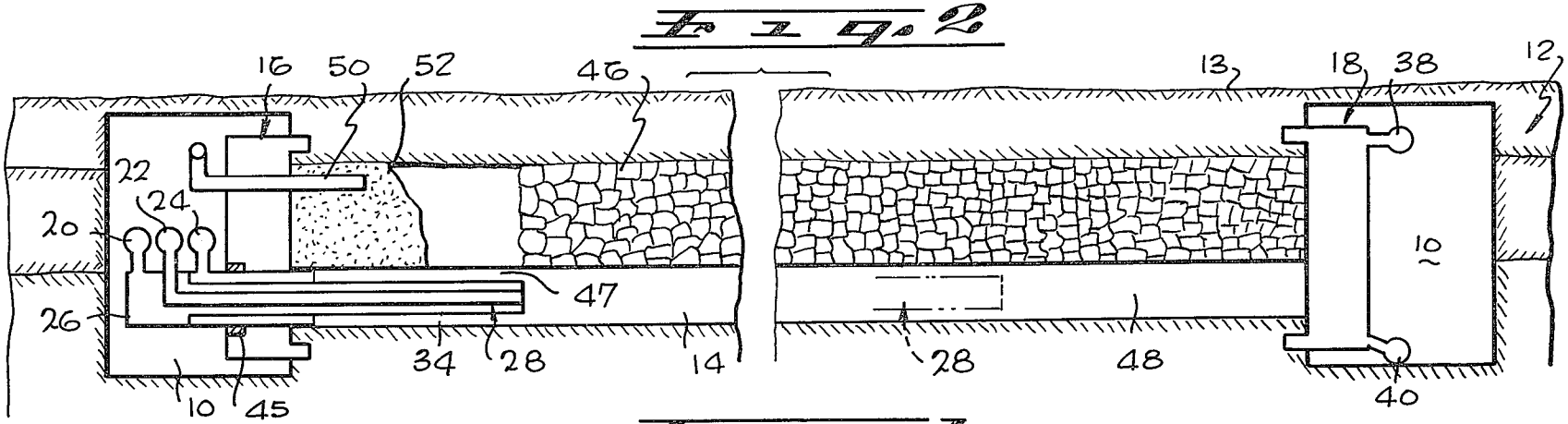
FIG. 2 is a schematic illustration showing an elevational view of the system of FIG. 1.
Figure 1:
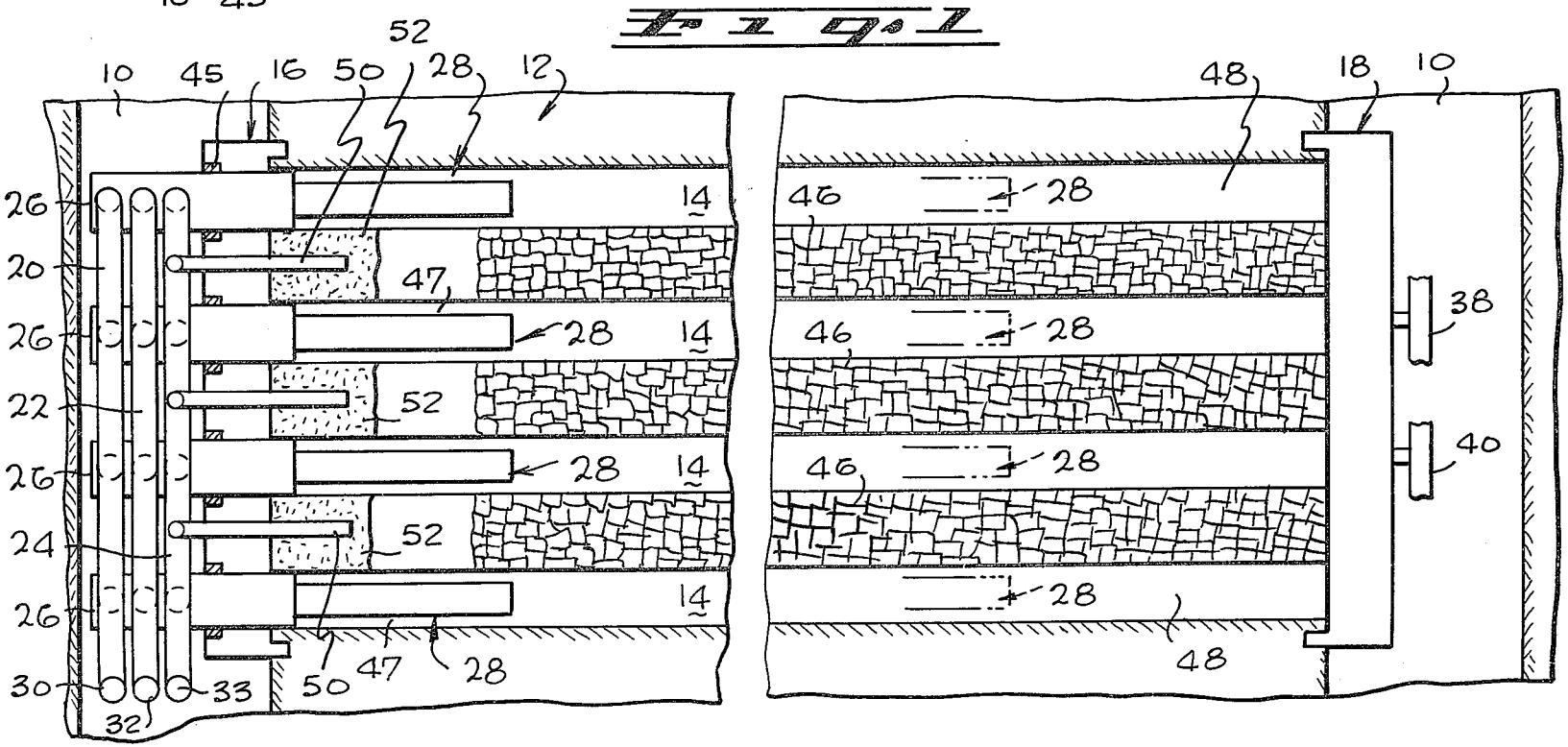
FIG. 1 is a schematic plan view of a preferred form of mining system employed for use in carrying out the invention process.

Referring to FIGS. 1 and 2 of the drawings, two tunnels, indicated by numeral 10, are driven into a coal seam 12 below the surface 13. The tunnels are positioned substantially parallel to each other, although not necessarily so, and are located some distance apart in the coal formation. A series of bore holes 14 are drilled in the coal formation between and interconnecting the tunnels 10. The width of the coal formation or zone 12 that should be operated at one time according to the invention, is dependent in large measure upon the local conditions encountered, but may range from about 100 to several hundred feet. The distance between the tunnels 10 also can vary widely and can be of any desired distance, but on a reasonably flat lying seam, such distance can range for example from about 100 to over 1,000 feet. The drilling can be conducted in but preferably at the bottom of the coal seam. For this purpose special support shoes (not shown) may be employed to allow the holes or bores 14 to remain in the coal seam and not drop down into any underlying shale. The spacing between the adjacent bore holes 14 will depend upon the thickness of the coal seam and other conditions and factors, including the distance between the adjacent tunnels 10, but for greatest effectiveness, it has been found that the bore holes 14 should be installed about 5 to about 50 feet apart and for optimum operation about every 10 feet apart. It will be understood of course that in varying or special circumstances, this distance can be substantially less or greater.

The bore holes 14 are interconnected at one end by a manifold 16 and at the other end by a manifold 18. Manifolds 16 and 18 are positioned in tunnels 10, and communicate with the opposite ends of each of the bore holes 14, the manifolds 16 and 18 being substantially parallel to each other. A series of parallel pipes 20, 22 and 24 positioned in one of the tunnels 10, are each connected to pipes 26 extending into such tunnel 10 and connected to the manifold 16, the pipes 26 communicating with the bores 14. Pipes 20 and 22 are air and steam inlet pipes, and pipe 24 is a flue gas exit pipe. Preferably, a movable air-steam pipe 28 is provided for passage through pipe 26 and into a bore hole 14, pipe 28 communicating with the air and steam inlet pipes 20 and 22. Thus, either air or oxygen at 30 can be introduced into pipe 20 alternately, by means of a temperature controlled sequence timer (not shown), with water or steam at 32 into pipe 22, for alternate injection of the air or oxygen, and the steam into the bore holes 14. The flue gas at 33 exits the bore holes 14 from a concentric area or pipe 34 around pipe 28, and via pipe 24 near the air and steam entrance pipes.

The product gas and oil produced in the process exit the bore holes 14 from the opposite end of the bore holes through the manifold 18, and exit from pipes 38 and 40, respectively.

Heat exchange equipment (not shown) is located in both of tunnels 10 so that inlet and outlet gases and liquids can be heat exchanged with each other. Thus the inlet air 30 and inlet steam 32 are heat exchanged with the hot flue gas 33 exiting through pipe 24, for preheating the inlet air and steam. Also, heat exchange is provided between the hot products exiting from manifold 18 and the inlet air and steam. Such heat exchange equipment is of conventional type and forms no part of the invention and hence is not illustrated.

Thus for example, viewing FIG. 2*a*, product gas at 38 and product liquid at 40 can be passed in countercurrent heat exchange relation with air at 30 and steam at 32, in a heat exchanger indicated at 42, and the exiting air at 30' and exiting steam at 32' can then be passed in countercurrent heat exchange relation with flue gas 33 in a heat exchanger 44, to preheat the air, e.g. up to about 1,000° to about 2,000° F. and for preheating the steam, which is preferably pressurized as noted below.

Referring again to FIGS. 1 and 2, suitable seals such as indicated at 45 are provided for sealing the ends of the bore holes 14 into the gas-tight manifolds 16 and 18, in order to avoid inadvertent gas leaks which would create hazards within the operating area and reduce the efficiency of the operation. These are conventional seals but should be sufficiently flexible to allow for expansion or contraction of the mining area 12 and yet must also be tight and strong enough to withstand the pressure desired within the mining area. However, gas pressure such as flue gas pressure and product gas pressure are relatively nominal, so that such sealing is readily accomplished. It will be understood that adequate ventilation is provided by conventional means in the mining areas.

In operation, air, preferably preheated as noted above, e.g. to a temperature to about 1400° F, is first injected via line 20 into the bore holes 14, and the coal 46 surrounding the bore holes 14 at one end 47 thereof adjacent the air inlet and manifold 16, viewing FIG. 2, is set afire either due to the heat of the injected air or oxygen, or by special external means such as a formation-lighting device, e.g. by remotely controlled electrical ignition. The air is introduced via pipe 20 at a pressure, e.g. of between about 5 and about 200 psig. As the coal adjacent the air inlet ends around the bore holes burns, the temperature of the coal is raised. During this period, flue gas including $CO_2$, $N_2$ and some CO, is removed via line 24. When the temperature of the coal is sufficiently hot to support the water gas reaction, e.g. when the coal reaches a temperature of about 1600° to about 2500° F., the flow of air and flue gas is stopped and preheated steam is admitted into the same end 47 of the bore holes as the previously admitted air. Preferably superheated steam is employed at a pressure of about 10 to about 200 psig. The superheated steam thus injected into the burning coal formation converts the coal to a water gas product, including carbon monoxide and hydrogen, and some carbon dioxide, which is removed from the opposite ends 48 of the bore holes and is exited via manifold 18. When the temperature of the coal has dropped to a level, e.g. about 1200° F., which will just allow combustion, the steam flow is stopped and the cycle is repeated by air injection and flue gas removal from end 47 of the bore holes 14, followed by steam injection and product gas and oil removal from the opposite ends 48 of the bore holes 14.

For this purpose, a suitable valving system (not shown) is provided wherein at appropriate time intervals, valves are switched for injecting alternately air and steam into the formation. Such valves can be arranged for actuation in response to conventional temperature sensors (not shown) which are disposed at a point in the coal formation near the burning front. In the most efficient operation, in which air is used rather than oxygen, it is desirable to have the air-steam pipes illustrated at 28 constantly moved through the bore holes 14 into the coal formation to place the air and the steam, as well as the temperature sensors, at a location close to the burning coal. This minimizes the back mixing of gases at each cycle change. Such movement can be carried out periodically by means of simple coupling connections and by packing glands, both of conventional design, and not shown. The movement of the air and steam pipes indicated at 28 through the bore holes 14 from the left or air and steam inlet ends 47 of the bore holes, to the right ends 48 thereof, as indicated by dotted lines in FIGS. 1 and 2, continues until the coal formations adjacent the bore holes are substantially exhausted.

As the coal is burned from the initial air inlet end of each of the bore holes 47 to the opposite end 48 thereof, backfill material preferably is likewise injected into the burnt out area of the coal, as desired for roof support. Such backfilling operation for roof support is optional and if desired, the drilling pattern can be such that large blocks of coal are left between adjacent mined out areas to act as pillars. Thus, pipes 50 can be provided in one of the tunnels 10 and passing through the manifold 16 for injection of mine tailings as at 52 into the burnt out portion of the formation adjacent the bores 14, especially near the front end 47 of the bores, both for thermal insulation and load support, or as a continuous mass where additional fill is available. It is also possible that controlled roof caving may be employed if desired, with the only restriction being that since in most locations coal appears in many parallel seams, the uppermost seams should be mined first before caving occurs in the lower lying seams. This will provide the maximum tightness or density to the formation for the mining of each seam in progression.

In practice, air and steam can be injected alternately into a single bore hole 14 at a time for burning and gasifying the coal formation 46 around each of the bore holes, or introduction of air and then steam alternately can take place simultaneously in two or more bore holes for simultaneously burning and gasifying the coal formation 46 adjacent such bore holes.

The product gases and oils conducted to the surface and exiting at 38 and 40 may be separated and sold directly. As previously noted, the product gas is composed essentially of CO and $H_2$, with some $CO_2$ present. Alternatively, the gases may have impurities such as sulfur dioxide and other impurities removed as by scrubbing in conventional manner, and then burned as a low BTU gas. On the other hand, such gas can undergo a shift conversion reaction followed by methanation, to produce a high quality pipeline gas. The product oils also produced may include light oil products such as benzene, toluene, xylene and naphtha. Also, tar chemicals such as naphthalene, tar acids and tar bases are present.

For thick coal seams the coal can be sufficiently undercut or some of the coal removed so that the remaining coal deposit can be blasted to expand it into a uniform mass of lump coal having good permeability, which fills the cavity. In such thick blasted deposits, the sequential air flow and steam flow can be in a vertical path, entering the top of the coal formation, with the air and steam pipes being projected into the coal deposit progressively downwardly, in a manner similar to that discussed above. The flue gases leave near the air entry end adjacent the top of the coal formation or mass, and the product gases leave with some oil through the opposite or lower end of the coal formation. In such an arrangement bore holes through the expanded mass for the conduct of the gas to the exit need not be employed. In thinner coal seams, the inlet and outlet gas flows can be in a horizontal direction.

Such an operation employing vertical gas flow is illustrated in FIGS. 3 and 4 of the drawing, wherein numeral 60 indicates a series of blasted and porous thick coal masses or formations of a coal seam, produced by undercutting or removing some of the coal from the coal seam and blasting. Air and steam pipes indicated at 62 and 64, respectively, are introduced into the top of the respective masses of coal 60 and a flue pipe 64' is also introduced into the top of the coal masses 60 at a point adjacent the air and steam pipes 62 and 64. An exit pipe 66 is introduced into the lower end of each of the coal formations 60 and is connected to a manifold 68 by means of a suitable seal 70, for collection of product gasses and oil.

Air and steam are alternately introduced into the top of the coal masses 60, in a manner as described above, to burn and partially combust, and to gasify the coal, with flue gases during burning exiting through pipe 64', and product gas and product liquid exiting and collected from the manifold 68, thus segregating flue gases from product. As burning and gasification of the coal formation adjacent the air and steam pipes progresses, the air and steam pipes are progressively lowered into the coal masses 60 to a point adjacent the bottom of such coal masses when the latter become essentially exhausted.

Although in preferred practice air is introduced into the coal to burn same and raise the temperature thereof sufficiently to support the endothermic water gas reaction, followed by injection of steam for carrying out the latter reaction, under certain conditions, for example where low priced oxygen is available, the partial oxidation or combustion reaction by injection of such oxygen, and the water gas reaction can be conducted simultaneously, that is by introduction of such oxygen and preheated steam together, so that the entire process is reduced to a single cycle of operation.

The following is an example of practice of the invention.

A system similar to that shown in FIGS. 1, 2 and 2*a* is provided in a coal seam. The two parallel tunnels provided therein are about 300 feet apart and the parallel bore holes interconnecting the tunnels are spaced about 10 feet apart.

Air preheated to about 1400° F is injected under pressure into the bore holes, and as the coal adjacent one end of the bore holes burns, flue gas is removed from the flue gas exit pipe. When the temperature of the coal reaches about 1800° to about 2000° F, the flow of air and flue gas is stopped and superheated steam at a pressure of about 50 psig is injected into the burning formation, the resulting product gas and product oil being recovered separately from their respective exit pipes without any intermixing of such products with flue gas. When the temperature of the coal drops to about 1200° F, the steam flow is stopped, the air and steam inlet pipes are moved farther into the bores to an adjacent portion of the coal formation, and the cycle is repeated. The alternate air and steam injection operations as described above are continued, and the air and steam pipes are moved progressively through the bores to adjacent unburned coal formations therein after each cycle of air and steam injections, until the coal formations adjacent the bore holes along the length thereof are exhausted.

As the coal is burned during the above noted cycles of operation, mine tailings are progressively injected into the burnt out portions of the coal formation for roof support.

During operation, flue gas, and product gas and product oil are passed in countercurrent indirect heat exchange relation with air and steam, for preheating same.

From the foregoing it is seen that the invention provides an efficient method for the in situ gasification of coal employing air or oxygen, and steam or water, under controlled conditions, and in conjunction with certain mining techniques, and wherein the air or oxygen, and the steam are placed where desired, particularly adjacent the burning coal formation, and wherein flue gases are segregated from product gas, so as to obtain high yields of a high quality fuel gas.

While I have described particular embodiments of my invention for purposes of illustration, it is understood that other modifications and variations will occur to those skilled in the art, and the invention accordingly is not to be taken as limited except by the scope of the appended claims.

I claim:

1. A process for the in situ gasification of coal which comprises injecting a gaseous source of oxygen into a coal formation adjacent one end of said coal formation, and burning a portion of said coal to raise its temperature sufficiently to support the water gas reaction, removing flue gas from said coal formation adjacent said one end thereof during said burning of said coal and injecting steam into said heated portion of said coal formation adjacent said one end of said formation, to convert said heated coal to a water gas product, removing said product gas at another end of said coal formation, thereby minimizing mixing of flue gas and product gas, said injection of said gaseous source of oxygen and said injection of steam being carried out in a cyclic manner, and continuing said combustion and gasification by said cyclic introducing of said gaseous source of oxygen and said steam into adjacent heated progressive portions of said coal formation.

2. The process as defined in claim 1, wherein the locations of said injection of said gaseous source of oxygen and of said steam into said coal formation are progressively moved into said adjacent heated portions of said coal formation.

3. A process for the in situ gasification of coal which comprises injecting a gaseous source of oxygen through an inlet into a coal formation adjacent one end of said coal formation, and burning a portion of said coal to raise its temperature sufficiently to support the water gas reaction, removing flue gas from said coal formation adjacent said one end thereof during said burning of said coal, stopping the flow of said gaseous source of oxygen, injecting steam through an inlet into said heated portion of said coal formation adjacent said one end of said formation, to convert said heated coal to a water gas product, removing said product gas at another end of said coal formation remote from said one end of said coal formation, thereby minimizing mixing of flue gas and product gas, and substantially segregating flue gas from product gas, and when the temperature of said heated portion of said coal formation has dropped to a level which will just permit combustion, stopping the flow of said steam, and repeating the aforesaid cycle of reintroducing said gaseous source of oxygen and said steam alternately into adjacent heated progressive portions of said coal formation.

4. The process as defined in claim 3, employing an injection pipe for said gaseous source of oxygen and an injection pipe for said steam, and wherein said injection pipes are progressively moved into said adjacent heated portions of said coal formations to minimize back mixing of said flue gas and said product gas.

5. The process as defined in claim 3, including a plurality of said coal formations, and said in situ gasification of each of said coal formations being carried out by alternate injection of said gaseous source of oxygen and said steam into each of said coal formations as aforesaid, and including collecting said product gas in a manifold connected to said another end of each of said coal formations opposite the air and steam inlet ends to said formations.

6. The process as defined in claim 4, including a plurality of said coal formations, and said in situ gasification of each of said coal formations being carried out by alternate injection of said gaseous source of oxygen and said steam into each of said coal formations as aforesaid, and including collecting said product gas in a manifold connected to said another end of each of said coal formations opposite the air and steam inlet ends of said formations.

7. The process as defined in claim 3, wherein said gaseous source of oxygen is air.

8. The process as defined in claim 6, wherein said gaseous source of oxygen is air.

9. The process as defined in claim 5, including bore holes adjacent and passing through each of said coal formations, said gaseous source of oxygen and said steam being alternately injected into each of said bore holes from one end of said bore holes adjacent one end of said coal formations, progressively to the opposite end of said bore holes adjacent said another end of said coal formations, and wherein said manifold is connected to said opposite ends of each of said bore holes for collecting said product gas.

10. The process as defined in claim 9, employing an injection pipe for said gaseous source of oxygen and an injection pipe for said steam, and wherein said injection pipes are progressively moved into said bore holes adjacent progressively heated portions of said coal formations to minimize back mixing of said flue gas and said product gas, from one end of said bore holes to the opposite ends thereof.

11. The process as defined in claim 10, including a second manifold connected to said one end of each of said bore holes for collecting said flue gas.

12. The process as defined in claim 11, wherein said gaseous source of oxygen is air.

13. The process as defined in claim 3, wherein said hot product gas is passed in indirect heat exchange relation with said gaseous source of oxygen and with said steam, for preheating same.

14. The process as defined in claim 3, wherein said hot flue gas is passed in indirect heat exchange relation with said gaseous source of oxygen and with said steam, for preheating same.

15. The process as defined in claim 7, wherein said hot product gas and said hot flue gas are passed in indirect heat exchange relation with said air and said steam for preheating same.

16. The process as defined in claim 12, wherein said hot product gas and said hot flue gas are passed in indirect heat exchange relation with said air and said steam for preheating same.

17. The process as defined in claim 3, wherein tailings are injected into the burnt out coal formation for roof support.

18. The process as defined in claim 12, wherein tailings are progressively injected into each of said coal formations adjacent said bore holes, as said coal formations are burnt out, for roof support.

19. The process as defined in claim 3, including blasting a coal body and forming a plurality of said coal formations, said coal formations being porous, said in situ gasification of each of said coal formations being carried out by alternate injection of said gaseous source of oxygen and said steam from adjacent pipe inlets into the top of each of said coal formations, said pipe inlets being progressively moved downward into each of said coal formations during combustion and gasification of said coal, removing said flue gas from an outlet pipe at the top of each of said coal formations adjacent to said pipe inlets, and including collecting said product gas in a manifold connected to the lower end of each of said coal formations remote from said inlet pipes.

20. The process as defined in claim 19, wherein said gaseous source of oxygen is air.

21. A process for the in situ gasification of coal which comprises forming substantially parallel access tunnels in a coal formation, forming a plurality of bore holes between adjacent parallel tunnels, the opposite ends of said bore holes communicating with said tunnels, providing a first manifold in one of said tunnels, one end of each of said bore holes connected to said first manifold, providing a second manifold in another adjacent one of said tunnels, the opposite ends of each of said bore holes connected to said second manifold, injecting alternately a gaseous source of oxygen and steam through said first manifold into one end of each of said bore holes to burn and gasify the coal in said formation adjacent each of said bore holes, removing flue gas from said one end of each of said bore holes but separated from said gaseous source of oxygen and said steam, and removing product gas exiting from the opposite end of each of said bore holes and through said second manifold, thereby substantially segregating flue gas from product gas.

22. The process as defined in claim 21, wherein said gaseous source of oxygen is air and said air is injected into said one end of each of said bore holes for a period to burn a portion of the adjacent coal formation to raise its temperature sufficiently to support the water gas reaction, and said air injection is stopped, and then said steam is injected into said one end of each of said bore holes and into said heated portion of said coal formation to convert said heated coal to a water gas product including oil, said period of steam injection taking place until said heated portion of said coal formation has dropped in temperature to a level which will just permit combustion, and said cycle is repeated progressively from said one end of said bore hole to the opposite ends thereof, until said coal formation is substantially exhausted.

23. The process as defined in claim 22, employing an injection pipe for said air and an injection pipe for said steam, said injection pipes being progressively moved through said bore holes into adjacent progressively heated portions of said coal formation from said one end of said bore holes to the opposite end thereof, to minimize back mixing of said flue gas and said product gas.

24. The process as defined in claim 23, and wherein said hot product gas and said hot flue gas are passed in indirect heat exchange relation with said air and said steam for preheating same.

25. The process as defined in claim 23, wherein tailings are progressively injected into said coal formation adjacent said bore holes, as said coal formation is burnt out, for roof support.

26. A process for the in situ gasification of coal which comprises injecting a gaseous source of oxygen into a coal formation adjacent one end of said coal formation, and burning a portion of said coal to raise its temperature sufficiently to support the water gas reaction, removing flue gas from said coal formation adjacent said one end thereof during said burning of said coal simultaneously with injection of said gaseous source of oxygen, injecting steam into said heated portion of said coal formation adjacent said one end of said formation, to convert said heated coal to a water gas product, and removing product gas from said coal formation at another end thereof simultaneously with said steam injection, said injection of said gaseous source of oxygen and said injection of steam being carried out in a cyclic manner, and continuing said combustion and gasification by said cyclic introducing of said gaseous source of oxygen and said steam into adjacent heated progressive portions of said coal formation.

27. The process as defined in claim 3, employing controlled roof caving following burning out of said coal formation.

28. The process as defined in claim 6, employing controlled roof caving following burning out of said coal formation.

29. The process as defined in claim 6, wherein said gaseous source of oxygen and said steam are alternately injected into each of said coal formations at a time for successively gasifying said plurality of said coal formations.

30. The process as defined in claim 21, wherein said gaseous source of oxygen and said steam are alternately injected into each of said bore holes at a time for successively gasifying the coal formation around each of said plurality of bore holes.

31. The process as defined in claim 6, wherein said gaseous source of oxygen and said steam are alternately injected simultaneously into two or more of said plurality of said coal formations.

32. The process as defined in claim 21, wherein said gaseous source of oxygen and said steam are alternately injected simultaneously into two or more of said plurality of said bore holes, for simultaneously burning and gasifying the coal formations adjacent said two or more bore holes.

33. The process as defined in claim 19, wherein said alternate injection of said gaseous source of oxygen and said steam flow are in a vertical path.

34. The process as defined in claim 3, including blasting a coal body and forming a plurality of said coal formations, said coal formations being porous, said in situ gasification of each of said coal formations being carried out by alternate injection of said gaseous source of oxygen and said steam from adjacent pipe inlets into the top of each of said coal formations, said pipe inlets being progressively moved downward into each of said coal formations during combustion and gasification of said coal, removing said flue gas from an outlet pipe at the top of each of said coal formations adjacent to said pipe inlets, and including collecting said product gas in a manifold connected to each of said coal formations below said pipe inlets and remote from said inlet pipes.

35. A process for the in situ gasification of coal which comprises injecting a gaseous source of oxygen into a coal formation adjacent one end of said coal formation, and burning a portion of said coal to raise its temperature sufficiently to support the water gas reaction, removing flue gas from said coal formation adjacent said one end thereof during said burning of said coal and injecting steam into said heated portion of said coal formation adjacent said one end of said formation, to convert said heated coal to a water gas product, removing said product gas at another end substantially opposite said one end of said coal formation, thereby minimizing mixing of flue gas and product gas, and substantially segregating flue gas from product gas, said injection of said gaseous source of oxygen and said injection of steam being carried out in a cyclic manner, and continuing said combustion and gasification by said cyclic introducing of said gaseous source of oxygen and said steam into adjacent heated progressive portions of said coal formation.

* * * * *

UNITED STATES PATENT OFFICE

CERTIFICATE OF CORRECTION

PATENT NO. : 4,087,130

DATED : May 2, 1978

INVENTOR(S) : Donald E. Garrett

It is certified that error appears in the above-identified patent and that said Letters Patent are hereby corrected as shown below:

In the claims:

Column 8, line 13, delete "water gas product" and insert -- product gas --; line 38, delete "water gas product" and insert -- product gas --; Column 10, line 35, delete "hole" and insert -- holes --; line 63, delete "water gas product" and insert -- product gas --; line 64, before "product" insert -- said --. Column 12, line 23, delete "water gas product" and insert -- product gas --.

Signed and Sealed this

*Third* Day of *July 1979*

[SEAL]

*Attest:*

*Attesting Officer*

LUTRELLE F. PARKER

*Acting Commissioner of Patents and Trademarks*